US006013012A

United States Patent [19]

Carman et al.

[11] Patent Number: 6,013,012

[45] Date of Patent: Jan. 11, 2000

[54] APPARATUS FOR STABILIZING A TREADMILL

[75] Inventors: Michael A. Carman, Hopkinton, Mass.; Gerard J. Theroux, Woonsocket, R.I.; Raymond Giannelli, Medway, Mass.

[73] Assignee: Cybex International, Inc., Medway, Mass.

[21] Appl. No.: 09/072,652

[22] Filed: May 5, 1998

[51] Int. Cl.[7] ..... A63B 22/02

[52] U.S. Cl. ..... 482/54; 482/51

[58] Field of Search ..... 482/51, 54

[56] References Cited

U.S. PATENT DOCUMENTS

| | | | |
|---|---|---|---|
| 4,664,371 | 5/1987 | Viander | 482/54 |
| 5,518,471 | 5/1996 | Hettinger et al. | 482/54 |
| 5,830,114 | 11/1998 | Halfen et al. | 482/54 |

*Primary Examiner*—Glenn E. Richman

[57] ABSTRACT

In a treadmill having a controllably pivotable frame supporting a platform on which a user stands, walks or runs, wherein the frame is seated on a stationary surface and has a selected longitudinal front to rear pivot length and a selected pivot axis disposed at a first position along the longitudinal pivot length of the treadmill, an apparatus for stabilizing the seating of the treadmill on the stationary surface, the apparatus comprising: a rigid support member having a tilt guide section interconnected to the frame at a second position along the longitudinal length of the treadmill, the second position being spaced a predetermined distance from the first position along the longitudinal length of the treadmill, the support member being mounted in a generally upright disposition and having a bottom end for engaging the stationary surface; the bottom end of the rigid support member comprising a motion resistant surface for immovably seating the support member on the stationary surface; the rigid support member supporting the platform above the stationary surface through the interconnection of the guide section to the frame, the bottom end of the support member being seated on the stationary surface.

11 Claims, 8 Drawing Sheets

APPARATUS FOR STABILIZING A TREADMILL

BACKGROUND

The present invention relates to exercise treadmills and more particularly to mechanisms for tilting the running or walking platforms of treadmills. Treadmills are typically provided with an endless belt which is driven around a pair of rollers as a platform on which a user runs or walks for exercise. In recent years, a variety of mechanisms have been developed for causing the treadmill to tilt upwardly to simulate the effect of running or walking uphill. Those apparatuses developed to date for tilting treadmills do not stabilize the treadmill against movement in the forward to back or side-to-side directions but rather utilize lifting mechanisms which cause the treadmill to move laterally or forwardly or backwardly and thus render the treadmill less stable.

SUMMARY OF THE INVENTION

In accordance with the invention therefore, there is provided in a treadmill having a controllably pivotable frame supporting a platform on which a user stands, walks or runs, wherein the frame is seated on a stationary surface and has a selected longitudinal front to rear pivot length and a selected pivot axis disposed at a first position along the longitudinal pivot length of the treadmill, an apparatus for stabilizing the seating of the treadmill on the stationary surface, the apparatus comprising: a rigid support member having a tilt guide section interconnected to the frame at a second position along the longitudinal length of the treadmill, the second position being spaced a predetermined distance from the first position along the longitudinal length of the treadmill, the support member being mounted in a generally upright disposition and having a bottom end for engaging the stationary surface; the bottom end of the rigid support member comprising a motion resistant surface for immovably seating the support member on the stationary surface; the rigid support member supporting the platform above the stationary surface through the interconnection of the guide section to the frame, the bottom end of the support member being seated on the stationary surface.

The longitudinal front to rear pivot length of the frame is the straight line distance between the point on the stationary surface around which the frame pivots and the point of interconnection of the frame to the tilt guide section of the rigid support member.

The tilt guide section of the rigid support member preferably has an arcuate profile having a radius of curvature equal to the predetermined distance between the first and second positions along the longitudinal pivot length of the frame.

The support member is typically interconnected to the frame by a tilt mechanism which is rigidly connected to the frame, the tilt mechanism driving the frame along the guide section of the support member, the frame being tilted as the tilt mechanism drives along the guide section of the support member.

The support member is typically interconnected to the frame by a tilt mechanism which is rigidly connected to the frame, the tilt mechanism driving the frame along the arcuate profile of the tilt guide section of the support member.

A pivot drive mechanism is preferably drivably interconnected to the tilt mechanism, the drive mechanism being controllably drivable to move the tilt mechanism along the arcuate profile of the tilt guide section of the support member.

Further in accordance with the invention, there is provided in a treadmill having a controllably pivotable frame supporting a platform on which a user stands, walks or runs, wherein the frame is seated on a stationary surface and has a selected longitudinal front to rear pivot length and a selected pivot axis disposed at a first position along the longitudinal pivot length of the frame, an apparatus for stabilizing the seating of the treadmill on the stationary surface, the apparatus comprising: a rigid support member having a tilt guide section interconnected to the frame at a second position along the longitudinal length of the frame, the second position being spaced a predetermined distance from the first position along the longitudinal length of the frame, the support member being mounted in a generally upright disposition and having a bottom end for engaging the stationary surface; wherein the tilt guide section of the rigid support member has an arcuate profile having a radius of curvature equal to the predetermined distance between the second and first positions; the rigid support member supporting the frame above the stationary surface through the interconnection to the frame, when the bottom end of the support member is seated on the stationary surface.

BRIEF DESCRIPTION OF THE DRAWINGS

The present invention is described in detail below with reference to the accompanying drawings which depict one or more embodiments of the present invention wherein.

DETAILED DESCRIPTION OF THE INVENTION

Figure 1:
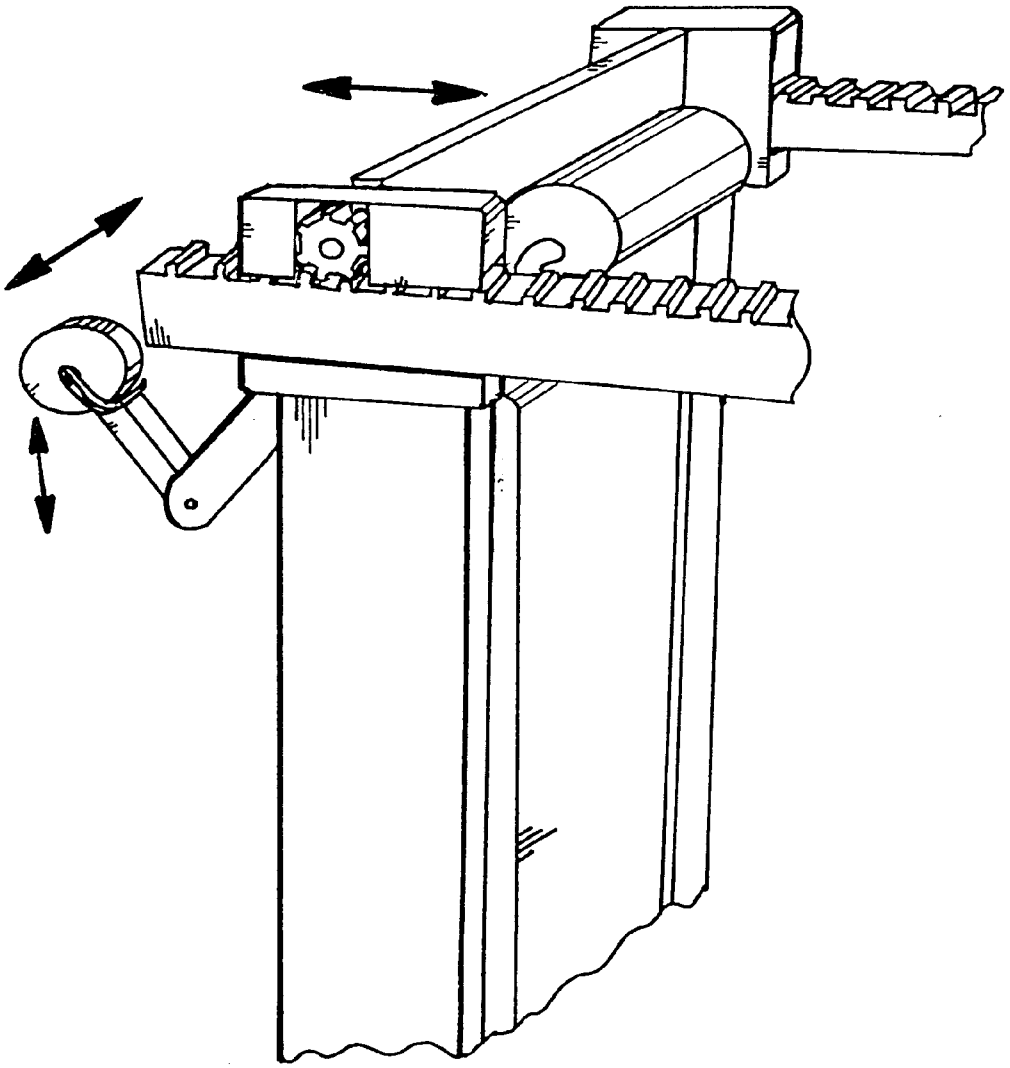
Fig. 1 (PRIOR ART)
FIG. 1 shows a tilting mechanism used in prior treadmills.
Figure 2:
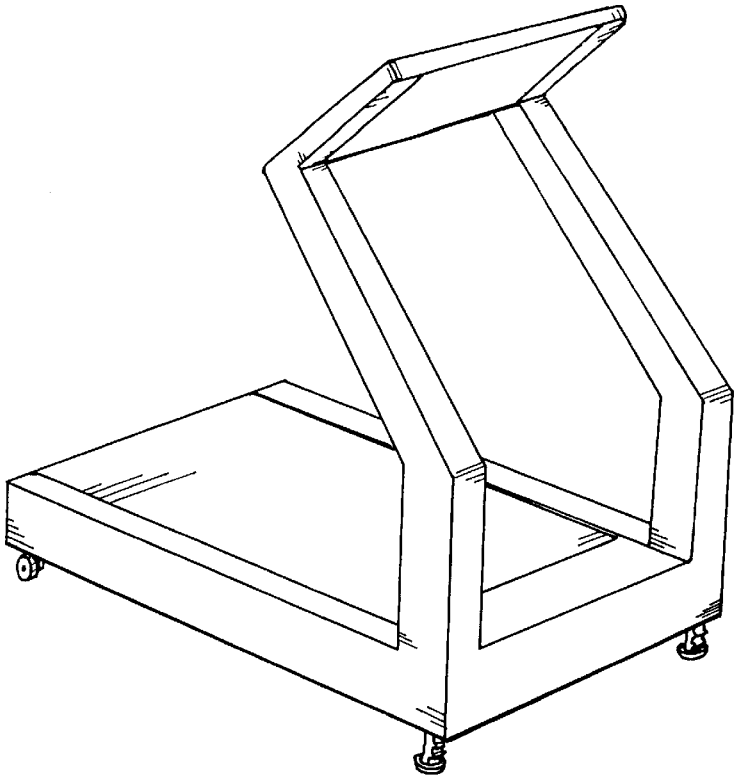
FIG. 2 is a front perspective view of a treadmill containing a platform tilting mechanism according to the invention.

FIG. 2 shows a treadmill 10 according to the invention comprising a platform on which a user stands, walks or runs. The treadmill 10 is mounted on a preferably flat, stationary surface 30 via a pair of left and right side rearward wheels 40 which are rotatably connected to the frame 50 and support the platform 20 in a conventional manner. The bottom surface of the wheels 40 contact the surface 30 at a point 60 and thus act to support the rear end of the frame 50 and all other associated components above the surface 30. The front end of the platform 20 and its associated frame 50 are supported above the surface 30 by a pair of left and right side upright supports 70 having bottom ends 85, FIG. 3 which contact the surface 30 at points 80. The left and right rearward points 60 are separated from their respective left and right front points 80 by a straight line distance X, FIG. 1.

The bottom ends 85 of supports 70 which make contact with the surface 30 comprise a solid material which is resistant to slipping, sliding or rolling on surface 30, i.e., a material which resists rolling or sliding movement along surface 30 under the weight of the frame 50 and other treadmill components which bear down on the supports 70 (having a weight of at least about 5 lbs).

Surface 30 comprises a conventional floor material such as wood, stone, tile or other material having a relatively high resistance to slipping and relatively high coefficient of friction. The bottom ends 85 of supports 70 thus most preferably comprise a hard material which makes a hard contact, i.e., non-rolling, non-slipping contact with surface 30.

Similarly, the rearward supports 40 may comprise a structure other than a wheel, such as rods, blocks, feet or the like having a bottom end which makes a hard contact with the surface 30 and comprises a non-rollable, non-slidable material in the same manner as described above with reference to bottom ends 85 of supports 70.

Figure 3:
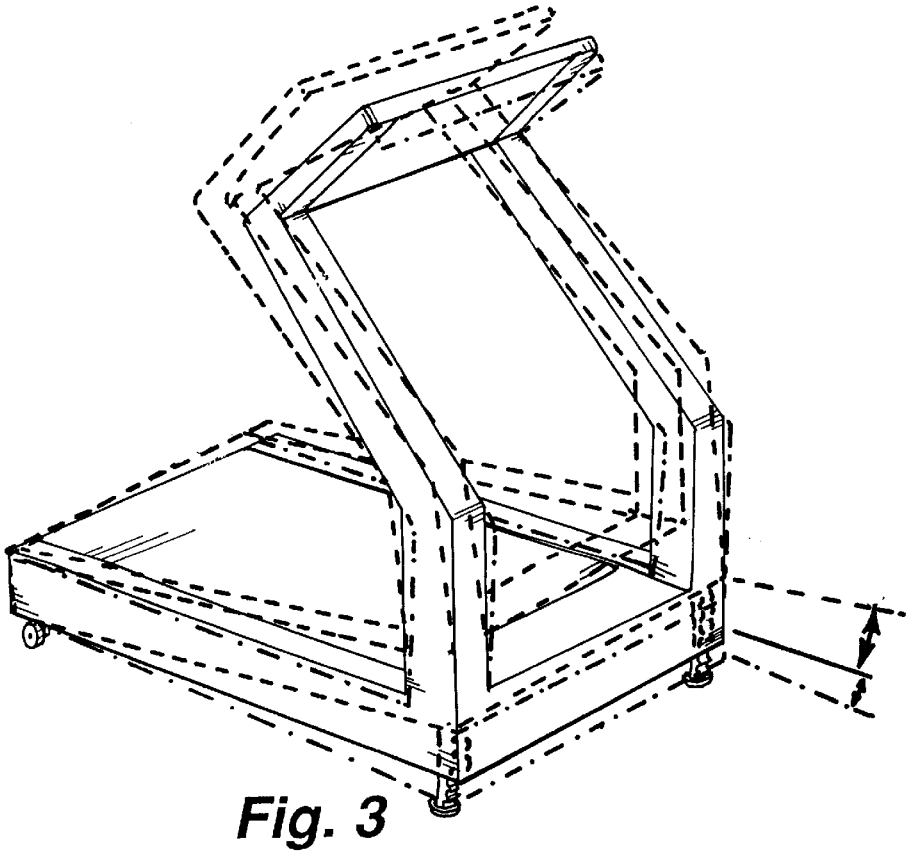
FIG. 3 is a view of FIG. 1 showing the treadmill in dashed line view in a tilted position.

The hard contact which the bottom ends 85 of supports 70 make with the stationary surface 30 provides stability against movement of the treadmill during operation when a user is standing, walking or running on the treadmill platform 20, particularly when the platform is in the process of tilting upwardly 10*a*, FIG. 3, or downwardly from its initial starting position (or otherwise) and the user is simultaneously wanting, running or standing on the platform 20 while it is tilting. The hard contact which the bottom ends 85 make with surface 30 serves to prevent front 26, back 25 or sideways 27, 28 movement of the treadmill which is highly preferable when a user is walking or running on the platform 20 in order to provide the highest level of safety for the user and to enable the user to feel stability against motion of the treadmill 10 which might otherwise occur in the front 26, back 25 or sideways 27, 28 directions when the user is moving on the platform 20.

As can be readily imagined, platform 20 typically comprises an endless belt tautly strung around front and rear rollers (not shown) at least one of which rollers is controllably driven by a motor, the drive speed of which is controllable by interconnection to a conventional speed control and/or program mechanism. The upper portion 21 of the endless belt on which the user stands is supported on its undersurface by a flat deck, typically comprised of wood or plastic, which is interconnected to the frame 50 and supports the weight of the user who is standing, running or walking on the belt 21.

Figure 4:
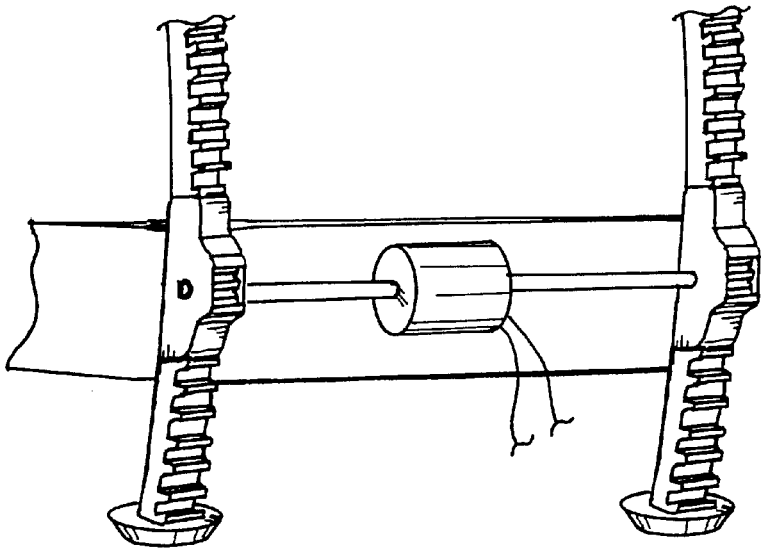
FIG. 4 is a front perspective view of the FIG. 1 treadmill showing a detail of upright support guide members engaged with positioning sleeve members.
Figure 5:
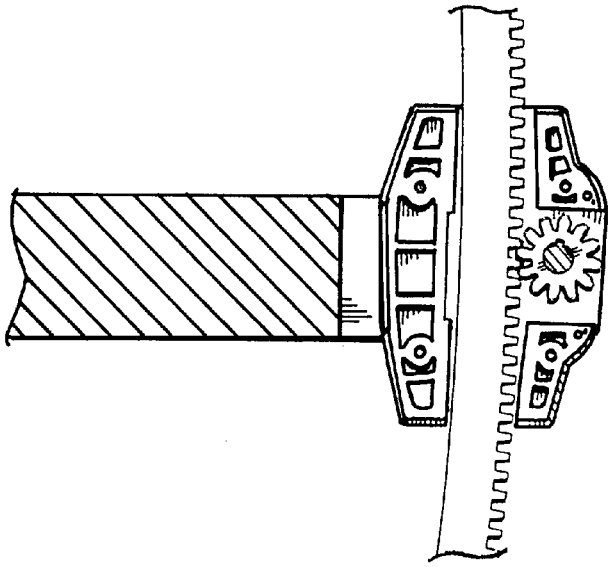
FIG. 5 is a side view of a FIG. 4 upright support and sleeve member showing an arrangement of a driven gear in relation to a rack of teeth on an upright support.
Figure 6:
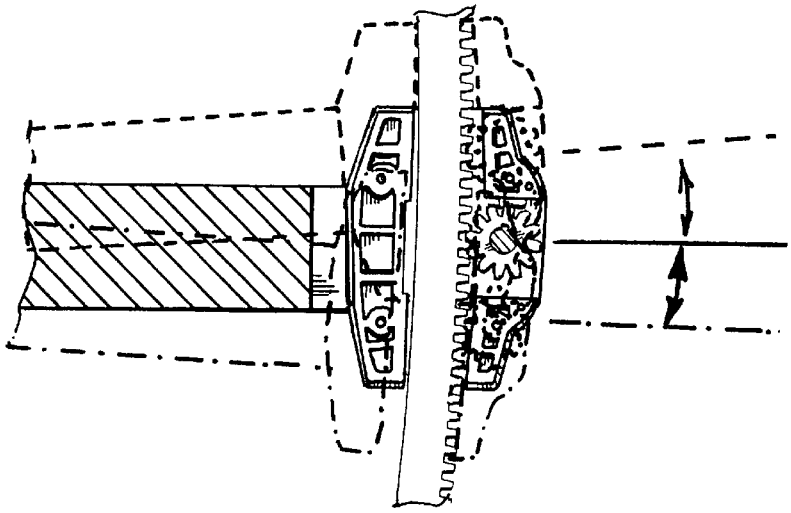
FIG. 6 is a view of FIG. 5 showing in dashed line the treadmill and sleeve component in raised and lowered positions.
Figure 7:
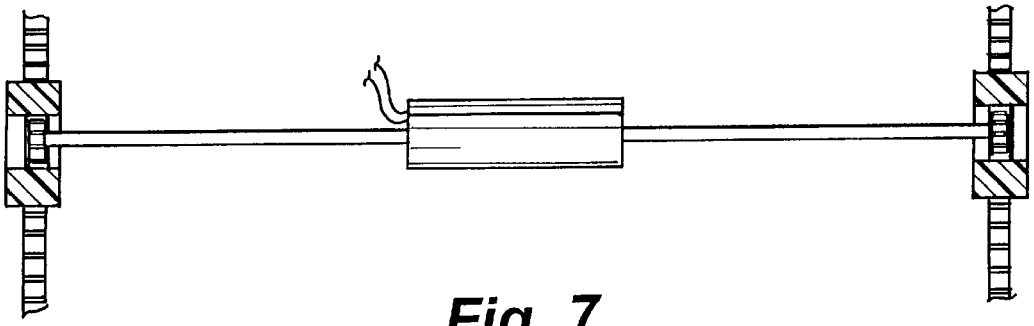
FIGS. 7 and 8 are front sectional views of the upright supports, sleeve and driven gear components shown in FIG. 4.
Figure 8:
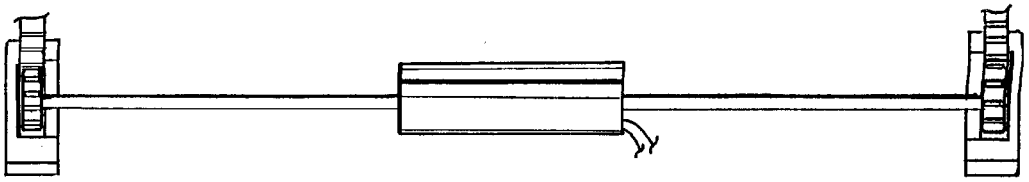
Figure 9:
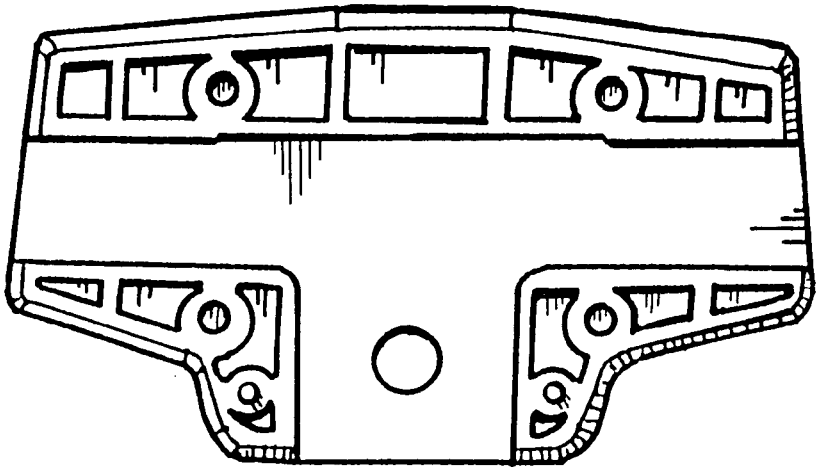
FIG. 9 is a side view of the sleeve component shown in FIGS. 4–5.
Figure 10:
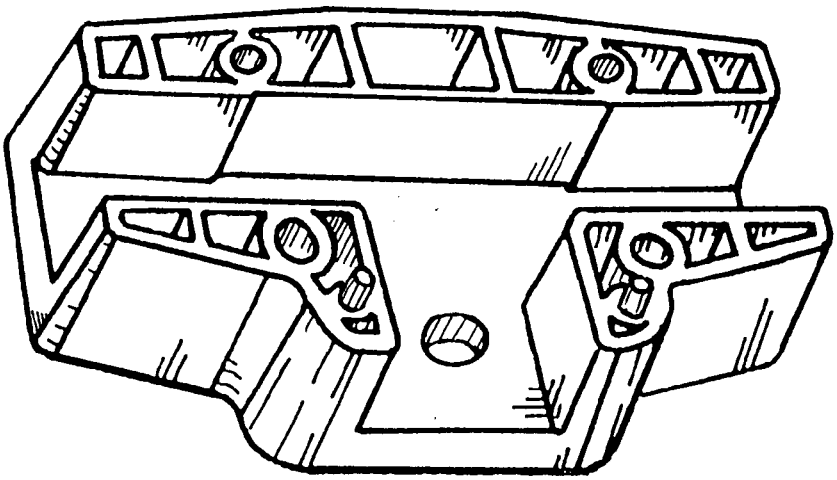
FIG. 10 is a side perspective view of the sleeve component shown in FIG. 9.

As shown in FIGS. 4–6 the front end of the frame 50 is rigidly connected to a guide sleeve 100 having a slot 105 within which a support 70 is mounted. Support 70 has a rack of teeth 120 which mesh with gears 110 as shown in FIG. 5. Gears 110 are driven by motor 75, the operation and speed of which is controlled by control mechanism 130. The control mechanism 130 may comprise a conventional motor controller and electronic, microprocessor or computer controller which is programmable by the user. As shown in FIG. 4, the sleeves 100 serve to hold and maintain the supports 70 in an upright and side-to-side position shown in FIGS. 2-6, 11. As can be readily imagined, as the motor 75 drives the axles 76 the gear 110 is rotatably driven and the sleeve 100 travels upwardly 100*a* or downwardly 100*b* along the length/contour of the supports 70. As shown, axles 76 are mounted in apertures 77 of guide sleeves 100 which mount and maintain gears 110 in the position shown in FIGS. 2–6. Because guide sleeves 100 are rigidly connected or interconnected to the frame 50, as the guide sleeve 100 moves up 100*a* or down 100*b*, FIG. 6, the entire frame 50 tilts upwardly 50*a*, FIG. 2, or downwardly around the rearward pivot point of contact 60 of supports 40 with the surface 30. Thus, the rearward point 60 is the pivot point for tilting of the entire frame 50 including the platform 20. As can be readily imagined, as the platform 20 is tilted upwardly such as 50*a*, FIG. 3, the user experiences the effect of walking or running uphill.

As shown in FIGS. 2, 4, 5, 6, 11 the upright supports 70 have a curvature. In the embodiments shown the curvature in the supports 70 extends the entirety of the longitudinal length of the supports from top 121 to bottom 122, FIG. 11. The curvature need not necessarily extend the entire length of the support 70 but only along so much of the length of the support 70, e.g., along length Y, FIG. 11, as is necessary to allow for the maximum degree of tilt as may be intended for users of the treadmill 10.

Figure 11:
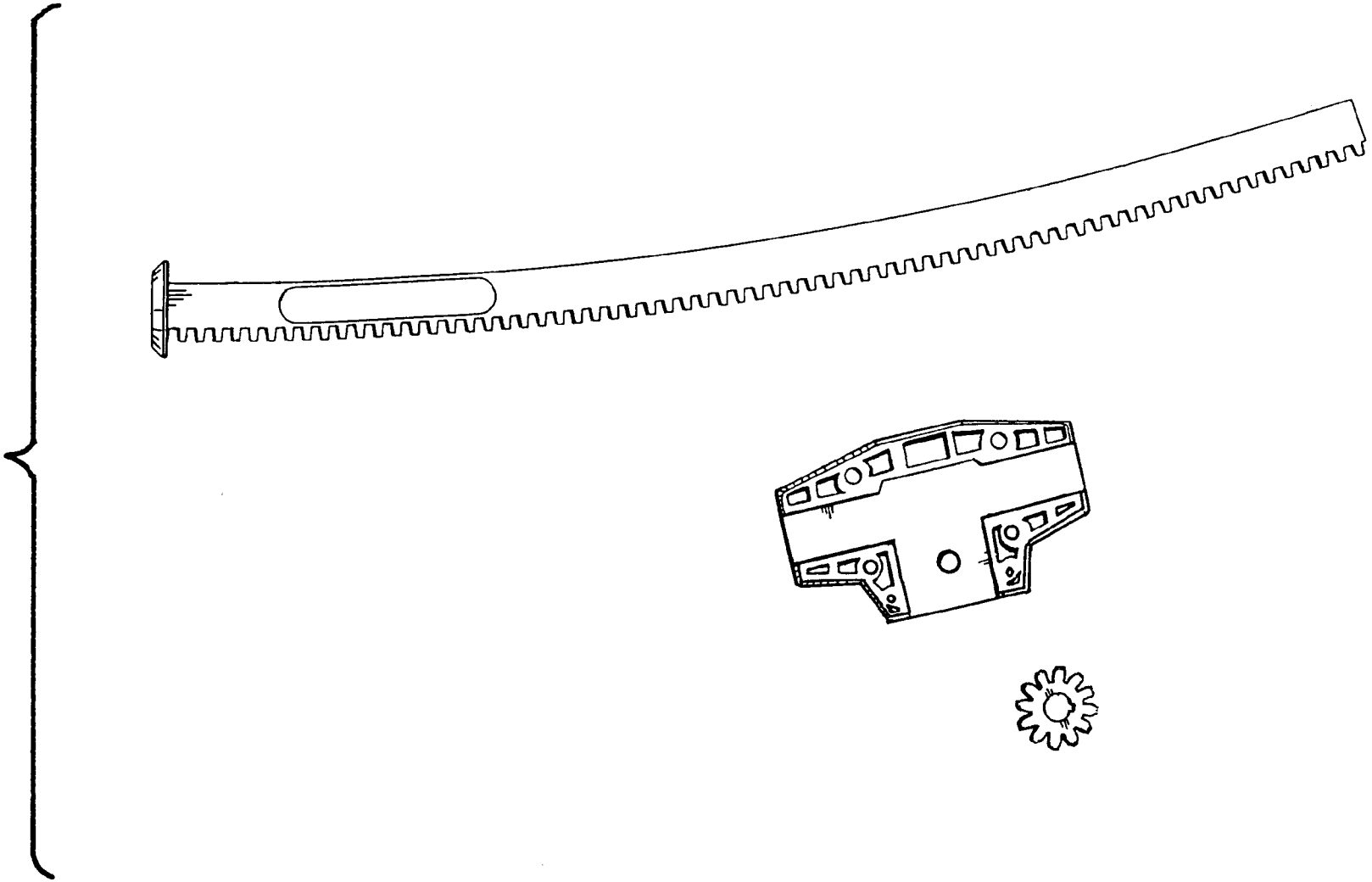
FIG. 11 is a side exploded view of the upright support, sleeve and gear components shown in FIGS. 5–8 showing the curvature of the upright support in greater detail.

The curvature of the support 70, FIGS. 2–6, 11 is determined by the distance X between the point 90 of engagement of the gear 110 with the rack of teeth 120, FIGS. 2, 5, 11 and the pivot point 60. More generally apart from the specific embodiment shown in FIGS. 2-1 1, the curvature of the supports is determined by the distance between the point 90 (or 91 or 92 or 93 or 94, FIGS. 12–15) where the front end of the frame 50 is effectively engaged with and supported by contact with the support 70 (or 71, 73, 77, 78, Fits. 12–15) and the pivot point 60. This distance is the longitudinal pivot length of the treadmill. Given the distance X between point 90 (or 91, 92, 93, 94) and point 60, the support 70 is provided with a circular curvature having a radius equal to X. In such an arrangement, as the driven component, such as gear 110, follows along the rack of teeth 120, the front end of the frame moves upwardly and the distance X between the point of engagement 90 and point 60 does not change. The frame 50 will thus not be subject to any force which will tend to move the frame 50 in any forward 26 or backward direction and the frame is thus stabilized against movement.

In prior treadmnills, FIG. 1, upright supports 500 which were sometimes utilized for effecting a front end lifting of a platform 410, were straight leaving no longitudinal curvature. Straight uprights 500 cause the front end of the frame 420 to be pulled forwardly or backwardly 430 as the front end is driven upwardly or downwardly 440 thus necessitating the use of a front wheel 400 as the support for the frame 420 to avoid dragging of the feet of the treadmill along the floor. The front to back 430 movement, FIG. 1, also renders the prior machines unstable to the user standing, walking or running on the treadmill.

Figure 12:
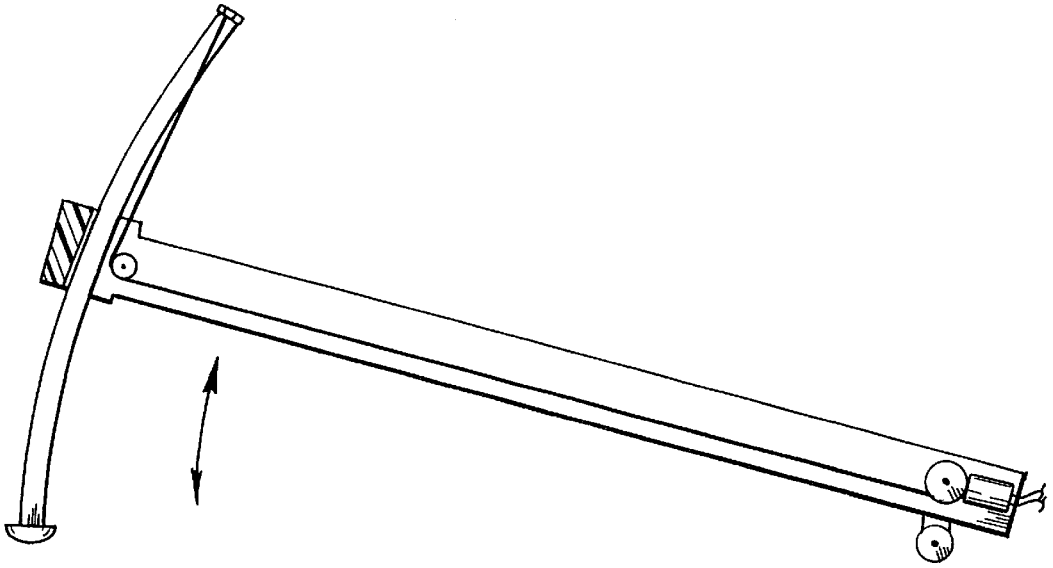
FIG. 12 is a side view of another embodiment of the invention wherein the driven lifting mechanism includes a cable interconnected between an upright support and a platform.

In the embodiment shown in FIG. 12, the curved upright support 71 is effectively engaged with the front end of the frame 51 by sleeve 200 which is rigidly connected to the frame 50. The support 71 is inserted within a complementary guide slot 201 within the sleeve 200. The effective engagement point is 91 within sleeve 200 which follows along the curvature of support 71. The front end of the frame has a pulley wheel 210 around which a cable 220 extends. The cable 220 is connected at one end to an upper point 72 of the support 71 and windably connected at another end to a controllably driven windup pulley 230. The windup pulley 230 is controllably driven by motor 240 and drive control mechanism 250 in the same conventional drive control manner as described above with reference to FIGS. 2-11. As can be readily imagined as the pulley 230 winds the cable 220 up, the front end of the frame 51 moves upwardly by virtue of the cable 220 pushing upwardly on the underside of pulley 210. As described above with reference to support 70, support 71 has a radius of curvature X as shown in FIG. 12.

Figure 13:
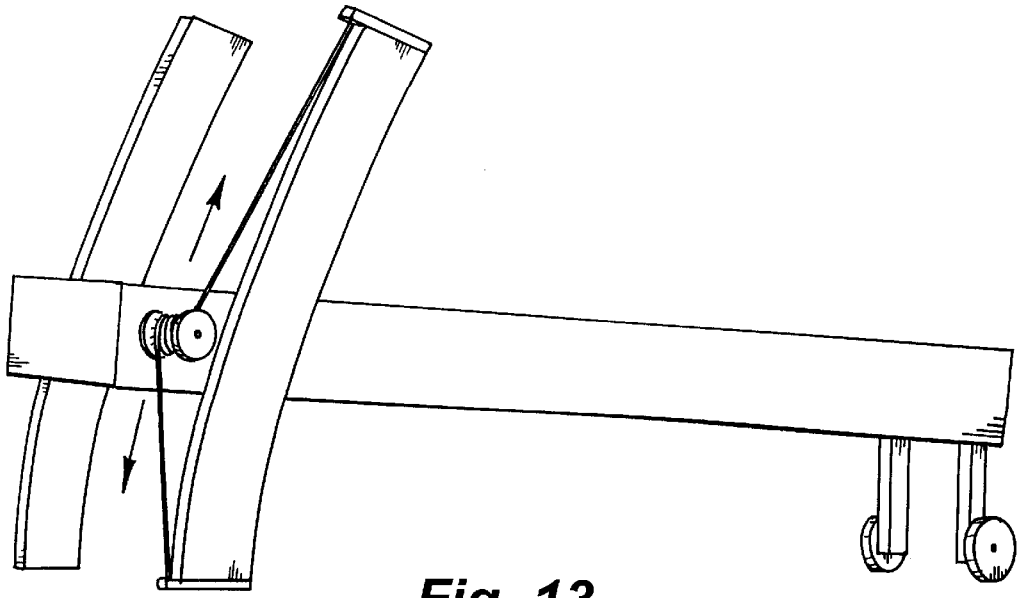
FIG. 13 is a side perspective view of another embodiment of the invention showing a cable interconnected between an upright guide support and a platform via a pulley connected to the platform.

With reference to the FIG. 13 embodiment a cable 221 is shown as connected at opposite ends to the top 75 and bottom 76 ends of support 73 and is wound around drive pulley 231. Pulley 231 is controllably driven around its axis by motor 251 and associated drive control mechanisms. As pulley 231 is driven counterclockwise, the ;front end of the frame 52 moves upwardly 245 and as pulley 231 is driven counterclockwise, the front end of the frame 52 moves downwardly 246. The axle 232 of the pulley is mounted in an aperture within the frame at point 92 which defines the effective engagement point with the curved uprights 73. As described above with reference to upright supports 70, upright supports 73 have a radius of curvature X as shown in FIG. 13.

Figure 14:
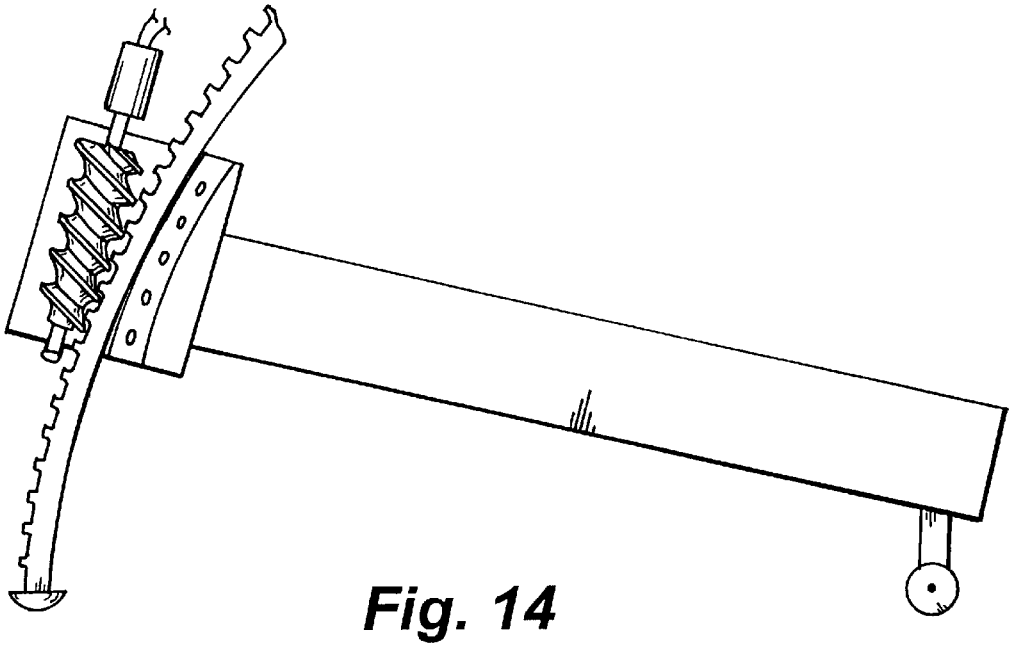
FIG. 14 is a side view of another embodiment of the invention showing a sleeve and a driven worm gear connected to a platform with the worm gear meshed with a complementary rack of teeth on an upright support member.

The embodiment shown in FIG. 14 utilizes a driven screw 300 to engage with a rack of teeth 122 provided on curved upright 77. The gear 300 is driven by a motor 330 the speed and operation of which is controllable by controller 252. Gear 300 is fixedly connected or interconnected to sleeve 310 which is connected to the frame 50 of the treadmill. As described above with reference to FIGS. 2–11, the controller 252 typically includes a program for controlling the drive of motor 330. The support 77 is held in meshed engagement with gear 300 by a guide bracket 311 which is attached to sleeve 310. As can be readily imagined, as screw 300 is driven the teeth of the screw engage/mech with the teeth 122 of the support 77 at point 93, the screw 300 follows the curved rack of teeth 122 and the front end of the frame 50 moves upwardly or downwardly via the fixed interconnection of the frame 50 to gear 300 via sleeve 310 as shown. As described above with reference to support 70, support 77 has a curvature X as shown in FIGS. 14.

Figure 15:
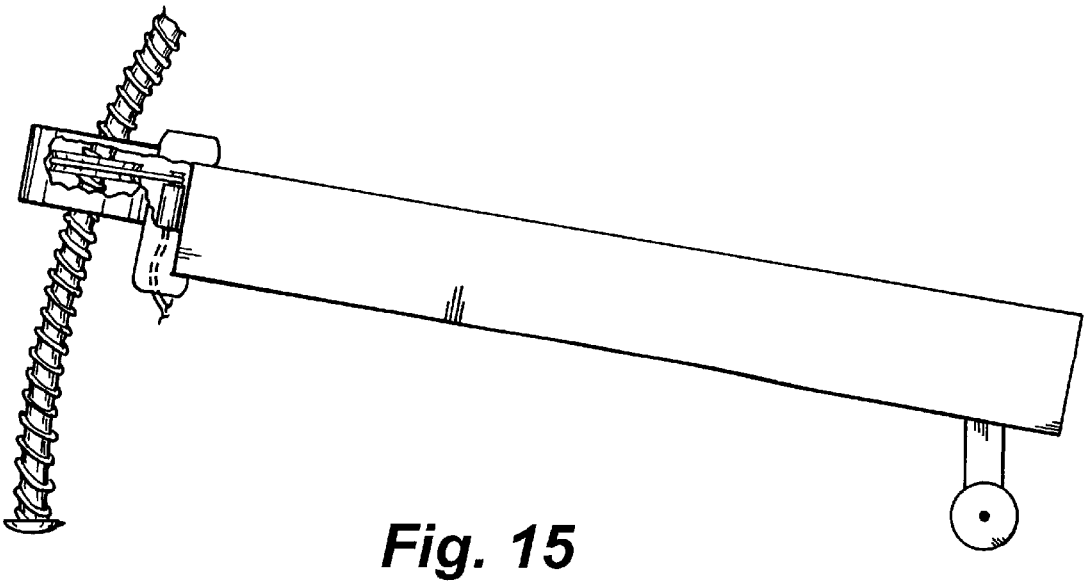
FIG. 15 is a side view of another embodiment of the invention showing a driven nut engaged with an upright support member having screw teeth.
Figure 1:
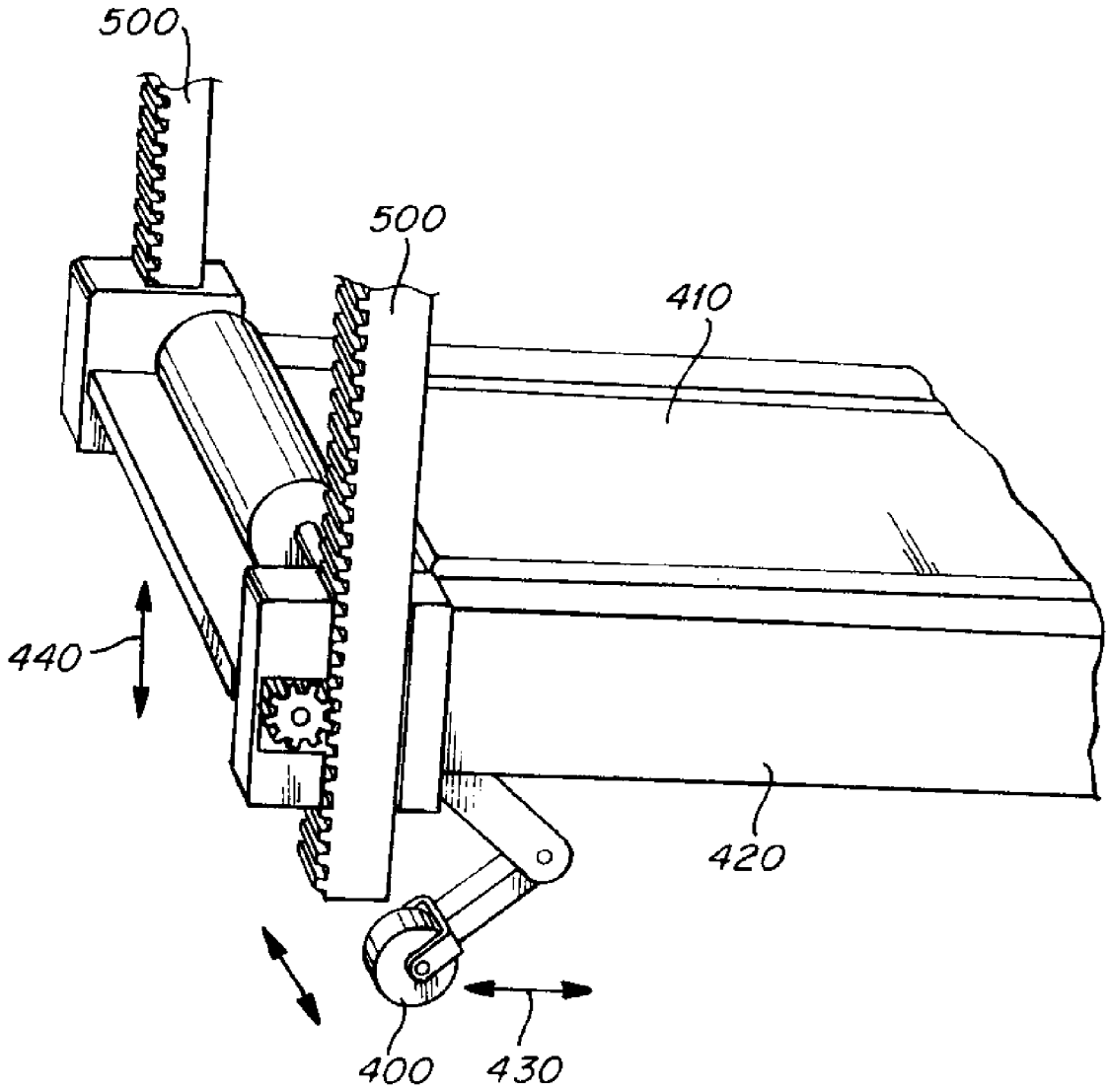
Fig. 1 (PRIOR ART)
Figure 4:
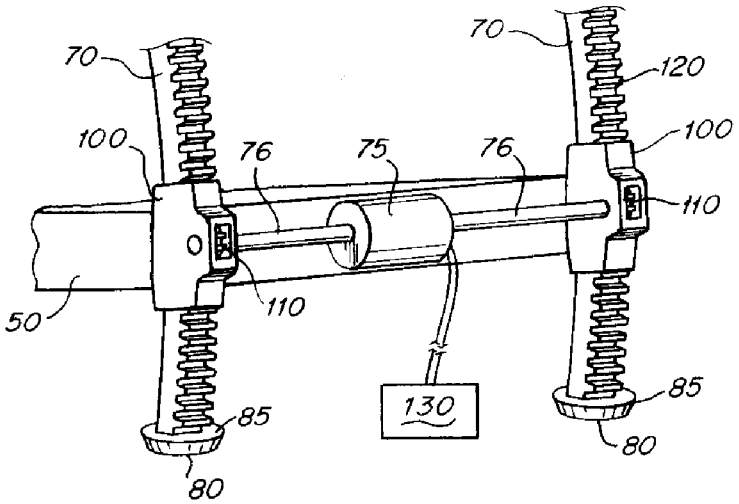
Figure 5:
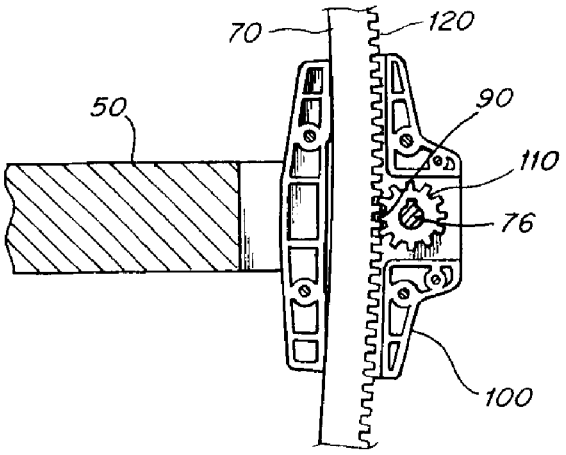
Figure 6:
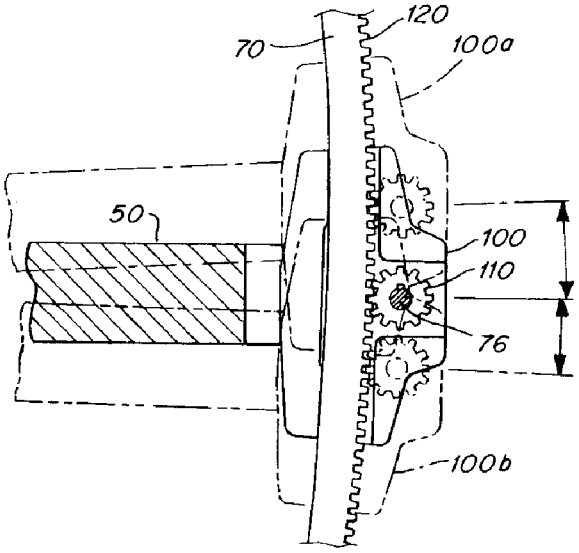
Figure 7:
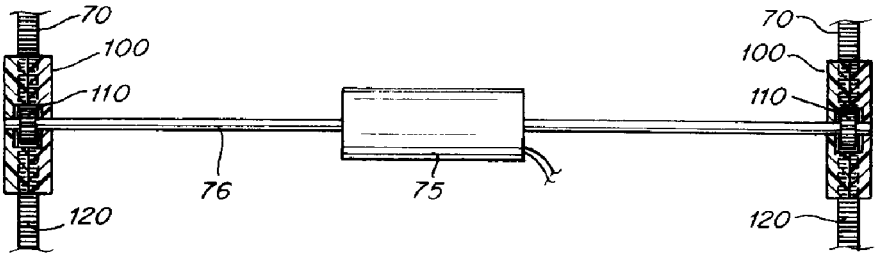
Figure 8:
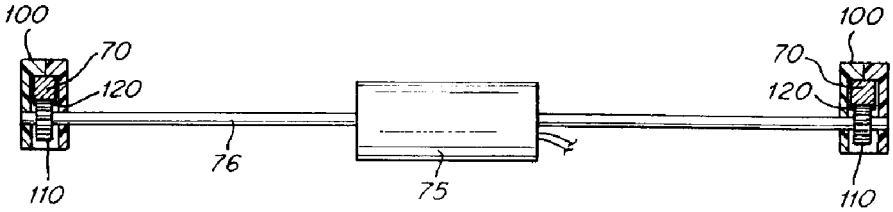
Figure 9:
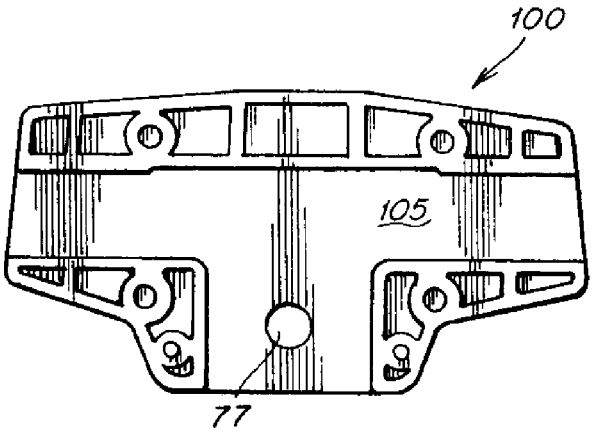
Figure 10:
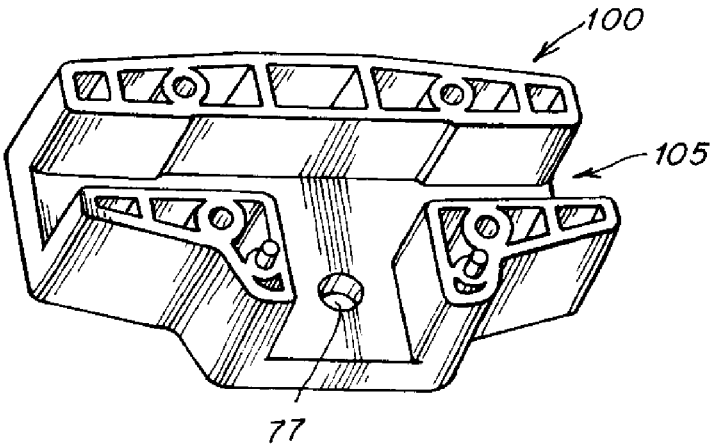
Figure 11:
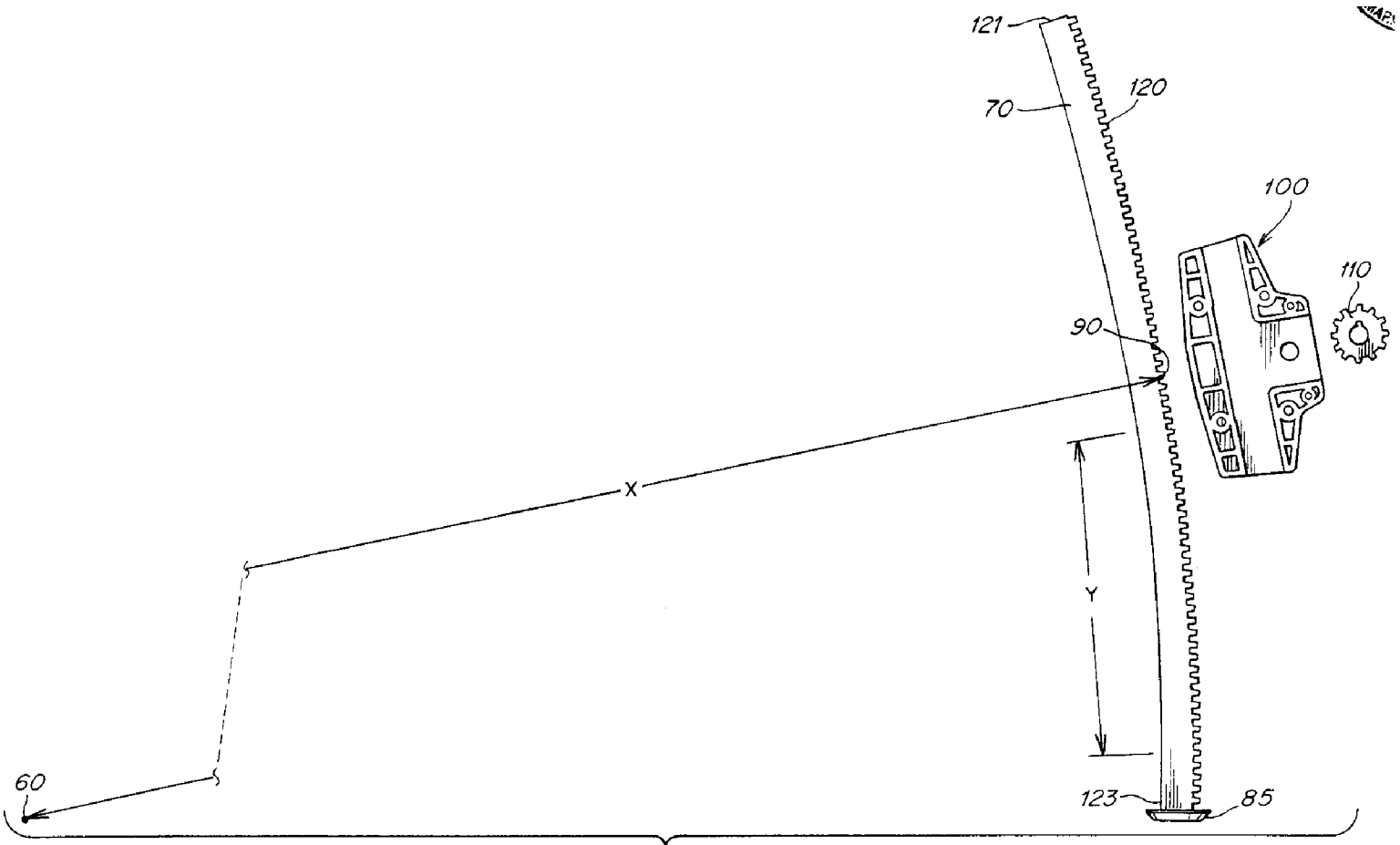
Figure 12:
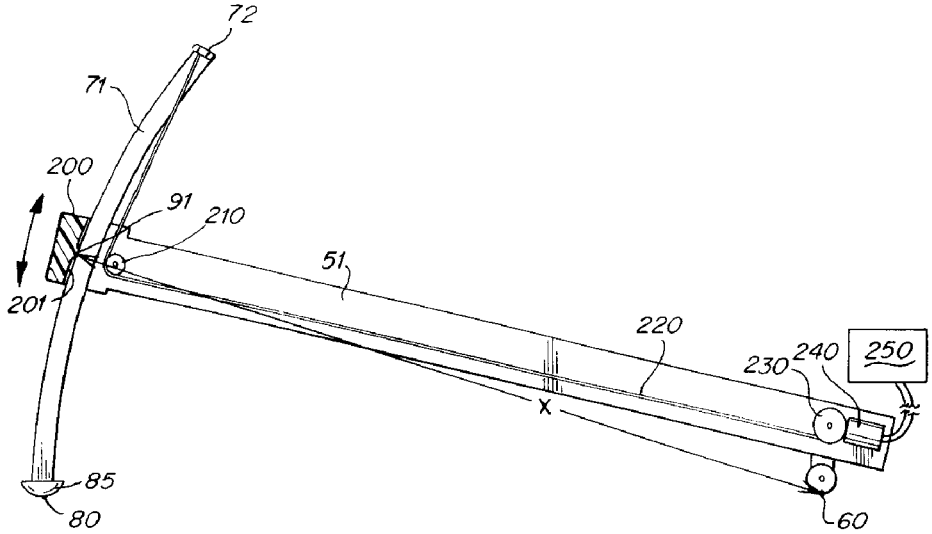
Figure 13:
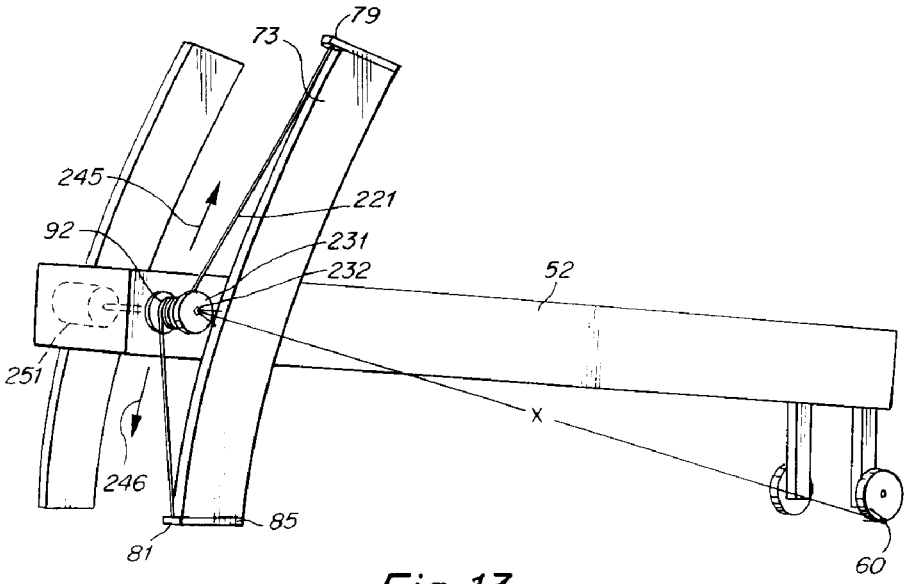
Figure 14:
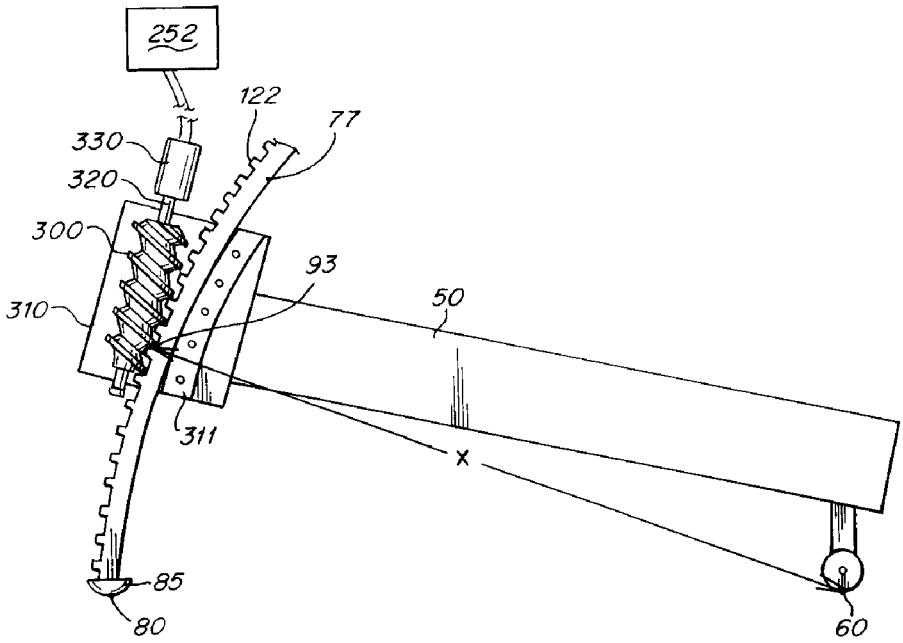
Figure 15:
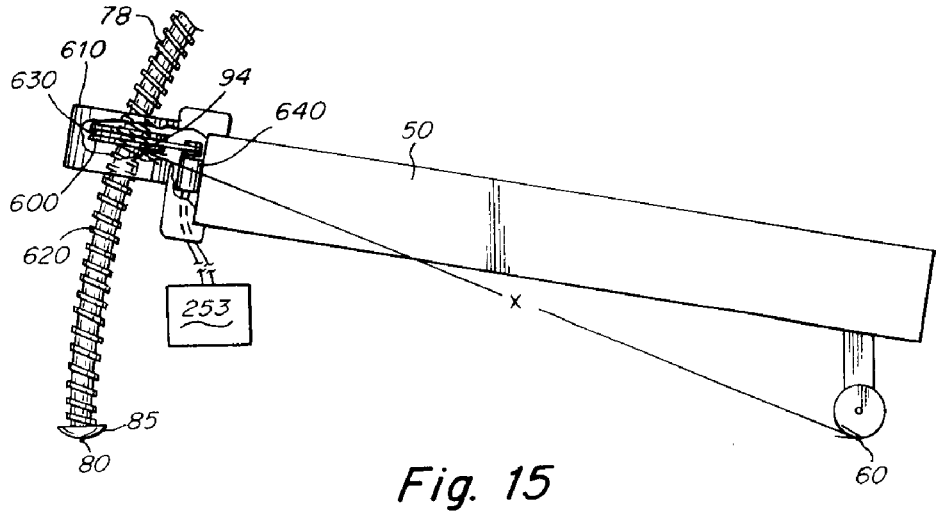

With reference to the FIG. 15 embodiment, a driven nut 600 is rotatably mounted in a sleeve 610 which is rigidly connected or interconnected to the front end of the frame 50 of the treadmill. The nut is engaged with support 78 which has screw threads 620, complementary to the nut 600 threads, extending to the longitudinal length of the support. As shown, the support 78 has a radius of curvature X equal to the distance X between the pivot point 60 and the point 94 which the nut 600 effectively engaged the support 78. The nut 600 is rotatably driven via a belt 630 which is driven by motor 640 the operation and speed which is controlled by controller 253.

In all of the embodiments described herein, the supports 70, 71, 73, 77, 78 comprise an elongated rod, bar and the like comprised of a rigid material such as metal which is capable of supporting a relatively high degree of weight for the purposes described herein, i.e., for supporting the weight of the front end of a treadmill in addition to the weight of one or more persons standing, walking or running on platform 20.

We claim:

1. In a treadmill having a controllably pivotable frame supporting a platform on which a user stands, walks or runs, wherein the frame is seated on a stationary surface and has a selected longitudinal front to rear pivot length and a selected pivot axis disposed at a first position along the longitudinal pivot length of the treadmill, an apparatus for stabilizing the seating of the treadmill on the stationary surface, the apparatus comprising:

a rigid support member having a tilt guide section interconnected to the frame at a second position along the longitudinal length of the treadmill, the second position being spaced a predetermined distance from the first position along the longitudinal length of the treadmill, the support member being mounted in a generally upright disposition and having a bottom end for engaging the stationary surface;

the bottom end of the rigid support member comprising a motion resistant surface for immovably seating the support member on the stationary surface;

the rigid support member supporting the platform above the stationary surface through the interconnection of the guide section to the frame, the bottom end of the support member being seated on the stationary surface.

2. The apparatus of claim 1 wherein the support member is interconnected to the frame by a tilt mechanism which is rigidly connected to the frame, the tilt mechanism driving the frame along the guide section of the support member, the frame being tilted as the tilt mechanism drives along the guide section of the support member.

3. The apparatus of claim 1 wherein the support member is interconnected to the frame by a tilt mechanism rigidly connected to the frame, the tilt mechanism driving the frame along the arcuate profile of the tilt guide section of the support member.

4. The apparatus of claim 3 further comprising a pivot drive mechanism drivably interconnected to the tilt mechanism, the drive mechanism being controllably drivable to move the tilt mechanism along the arcuate profile of the tilt guide section of the support member.

5. The apparatus of claim 2 further comprising a pivot drive mechanism drivably interconnected to the tilt mechanism, the drive mechanism being controllably drivable to move the guide mechanism along the tilt guide section of the support member.

6. In a treadmill having a controllably pivotable frame supporting a platform on which a user stands, walks or runs, wherein the frame is seated on a stationary surface and has a selected longitudinal front to rear pivot length and a selected pivot axis disposed at a first position along the longitudinal pivot length of the frame, an apparatus for stabilizing the seating of the treadmill on the stationary surface, the apparatus comprising:

a rigid support member having a tilt guide section interconnected to the frame at a second position along the longitudinal length of the frame, the second position being spaced a predetermined distance from the first position along the longitudinal length of the frame, the support member being mounted in a generally upright disposition and having a bottom end for engaging the stationary surface;

wherein the tilt guide section of the rigid support member has an arcuate profile having a radius of curvature equal to the predetermined distance between the second and first positions, the rigid support member supporting the frame above the stationary surface through the interconnection to the frame, when the bottom end of the support member is seated on the stationary surface.

7. The apparatus of claim 6 wherein the bottom end of the rigid support comprises a motion resistant surface for immovably seating the support member on the stationary surface.

8. The apparatus of claim 6 wherein the support member is interconnected to the frame by a tilt mechanism rigidly connected to the frame, the tilt mechanism driving the frame along the length of the arcuate profile of the tilt guide section of the support member as the frame pivots around the pivot axis.

9. The apparatus of claim 8 further comprising a pivot drive mechanism drivably interconnected to the tilt mechanism, the drive mechanism being controllably drivable to move the tilt mechanism along the arcuate profile of the tilt guide section of the support member.

10. The apparatus of claim 7 wherein the support member is interconnected to the frame by a tilt mechanism rigidly connected to the frame, the tilt mechanism driving the frame along the arcuate profile of the tilt guide section of the support member as the frame pivots around the pivot axis.

11. The apparatus of claim 10 further comprising a pivot drive mechanism drivably interconnected to the tilt mechanism, the drive mechanism being controllably drivable to move the tilt mechanism along the arcuate profile of the tilt guide section of the support member.

* * * * *

UNITED STATES PATENT AND TRADEMARK OFFICE

CERTIFICATE OF CORRECTION

PATENT NO. : 6,013,012 
DATED : January 11, 2000
INVENTOR(S) : Carman, Michael A., Theroux, Gerard J. and Giannelli, Raymond It is certified that error appears in the above-identified patent and that said Letters Patent is hereby corrected as shown below:

Drawings,
Replace Figures 1-15 with substitute Figures 1-15.

Column 6,
Line 36, change "surface." to -- surface; wherein the tilt guide section of the rigid support member has an arcuate profile having a radius of curvature equal to the predetermined distance between the first and second positions along the longitudinal pivot length of the frame. --

Signed and Sealed this

Twenty-second Day of February, 2005

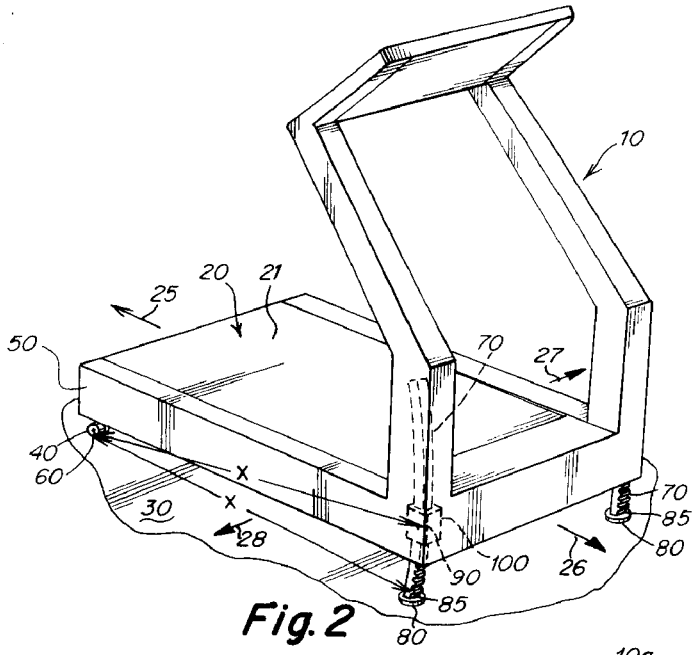
Fig. 2
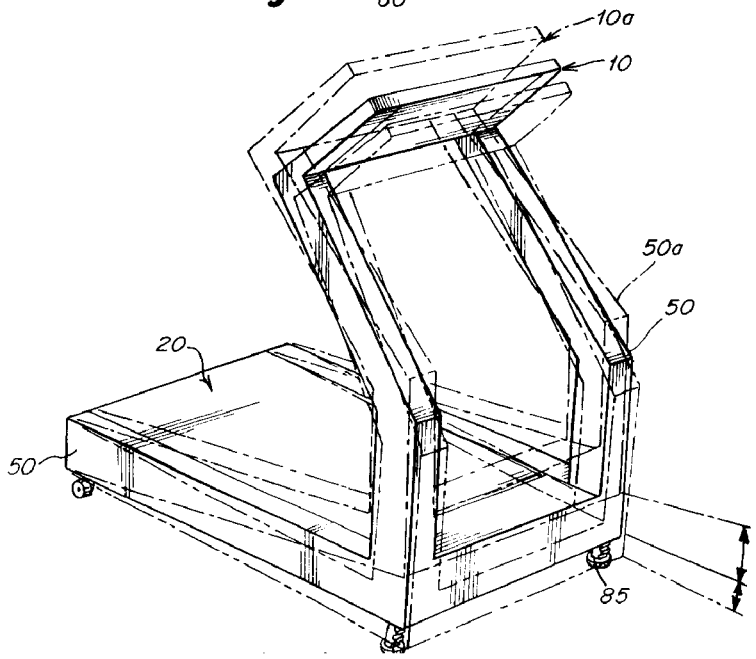

JON W. DUDAS
*Director of the United States Patent and Trademark Office*